US009636700B2

(12) United States Patent
Nitschke

(10) Patent No.: US 9,636,700 B2
(45) Date of Patent: May 2, 2017

(54) APPARATUS FOR WETTING A WEB OF MATERIAL WITH A LIQUID

(75) Inventor: Michael Nitschke, Bonn (DE)

(73) Assignee: Reifenhäuser GmbH & Co. KG Maschinenfabrik, Troisdorf (DE)

( * ) Notice: Subject to any disclaimer, the term of this patent is extended or adjusted under 35 U.S.C. 154(b) by 733 days.

(21) Appl. No.: 13/607,231

(22) Filed: Sep. 7, 2012

(65) Prior Publication Data

US 2013/0068158 A1 Mar. 21, 2013

(30) Foreign Application Priority Data

Sep. 7, 2011 (EP) ..... 11180429

(51) Int. Cl.
*B05C 11/00* (2006.01)
*B05C 21/00* (2006.01)
*B05C 1/08* (2006.01)

(52) U.S. Cl.
CPC ..... *B05C 11/00* (2013.01); *B05C 1/083* (2013.01); *B05C 21/005* (2013.01)

(58) Field of Classification Search
None
See application file for complete search history.

(56) References Cited

U.S. PATENT DOCUMENTS

| | | | | |
|---|---|---|---|---|
| 3,982,056 | A * | 9/1976 | Holder, Jr. | 427/361 |
| 6,264,743 | B1 | 7/2001 | Cucuzza | |
| 2004/0001919 | A1* | 1/2004 | Aderhold et al. | 427/294 |
| 2005/0115494 | A1* | 6/2005 | Tietz et al. | 118/68 |
| 2008/0044554 | A1 | 2/2008 | Lohr et al. | |

FOREIGN PATENT DOCUMENTS

| | | | | |
|---|---|---|---|---|
| DE | 1 063 892 | B | 8/1959 | |
| DE | 10 2006 038 339 | A1 | 2/2008 | |
| DE | 10 2008 040414 | A1 | 1/2010 | |
| WO | WO2009138335 | * | 11/2009 | B41F 19/06 |

* cited by examiner

*Primary Examiner* — Dah-Wei D Yuan
*Assistant Examiner* — Jethro M Pence
(74) *Attorney, Agent, or Firm* — Pauley Erickson & Kottis

(57) ABSTRACT

An apparatus for wetting a material web with a liquid in which the material web is guided in a travel direction through the apparatus, which includes guide means for guiding the material web and application means for applying the liquid to the material web. On the side of the material web oriented away from the application means, a spray guard is provided, which rests directly against the material web.

20 Claims, 1 Drawing Sheet

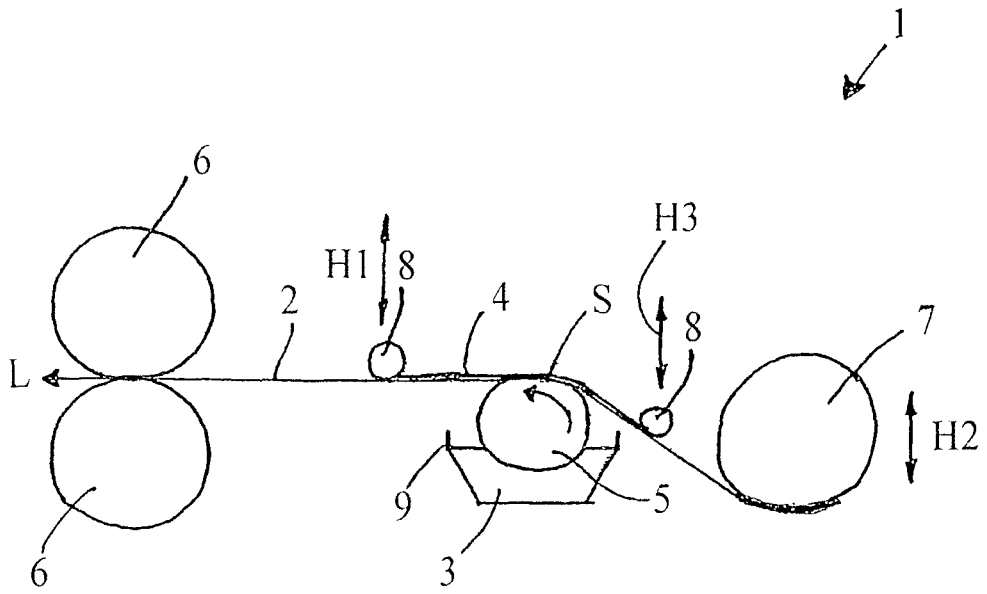
1
6
H1
8
H3
2
4
S
8
7
L
H2
9
5
6
3

APPARATUS FOR WETTING A WEB OF MATERIAL WITH A LIQUID

BACKGROUND OF THE INVENTION

Field of the Invention

This invention relates to an apparatus for wetting a web of material with a liquid. The material web is guided in a travel direction through the apparatus which includes a guide or guide means for guiding the material web and an applicator or application means for applying the liquid to the material web.

Discussion of Related Art

It is known for material webs such as a film, a nonwoven fabric, a paper, or a textile knit to be treated with generally liquid chemicals in order to provide the material web with a functional finish. This can, for example, be a coloring, an impregnation, a stain protection coating, a nanocoating, an antibacterial coating, or the like.

Such a method and a corresponding apparatus are known, for example, from German Patent Reference DE 10 2006 038 339 A1. In this case, the material web to be wetted is guided around a rotating application roller that is partially immersed in a chemical trough and applies the chemical from the trough to the material web. Two guide rollers that are respectively situated before and after the application roller guide the material web around the application roller.

One disadvantage of the apparatuses known from the prior art is that depending on the contact angle between the material web and the application roller, the material web speed, the material web grammage, the application roller speed, and the viscosity of the wetting substance, a permeation of the material web by the substance can occur at the apex of the application roller. Depending on the above-mentioned parameters, the degree of permeation can be so great that significant quantities of the wetting liquid emerge from the side of the material web oriented away from the application roller and are catapulted into the surroundings in a travel direction of the material web, thus producing an aerosol mist.

This aerosol mist is disadvantageous in many respects. It is deposited on surrounding surfaces of the equipment as a result of which these surfaces can become soiled and, depending on the chemical, can experience significant corrosion. Such a contamination of the equipment can reduce equipment safety. Buildup on floors and stairs results in slippery surfaces that form a risk of injury to personnel working on the apparatus. Under some circumstances, personnel are also exposed to harmful contamination of the breathable air by the aerosol mist. Liquid that is deposited on surrounding parts of the equipment, in particular crossbeams extending across the material web, can drip back onto the material web and thus negatively impact product quality. The aerosol mist escaping into the surroundings can result in a significant cost increase because up to 30% of the substance to be applied can pass through the material web and volatilize and thus cannot be used for the wetting.

Up to now, extraction hoods above the material web in the vicinity of the wetting have been used to extract the aerosol mist, but they represent a significant equipment expenditure and they can only be installed at a certain structurally required distance from the material web. For this reason, such devices cannot prevent liquid in the immediate vicinity of the wetted material web from volatilizing and/or becoming deposited on machine parts. The liquid that is deposited in the edge regions of the extraction hood can once again drip back onto the material web. Also, the extracted liquid generally can no longer be used for wetting and thus the loss of such liquid remains as insignificant as before.

SUMMARY OF THE INVENTION

One object of this invention is to provide an apparatus for wetting a material web with a liquid, which overcomes above-mentioned disadvantages of the prior art.

The above object and others can be attained with an apparatus having features described in this specification and in the claims.

Other exemplary embodiments and modifications of this invention are also discussed in this specification and in the claims.

The apparatus according to this invention for wetting a material web with a liquid has on a side of the material web oriented away from an application means, a spray guard which rests directly against the material web.

This invention provides a mechanical guard under which the material web travels over the application means and by which the diffusion of an aerosol mist in the vicinity of the material web can be effectively prevented directly at its source. To accomplish this, according to this invention, the spray guard rests directly against the material web, thus making it possible to completely prevent a volatilization of the wetting chemical and with it, a loss of application liquid. Instead, the spray guard resting against the material web achieves an even, homogeneous impregnation of the material web. Liquid that passes through the material web moistens the side of the spray guard oriented toward the material web, but is immediately removed from the subsequent material web. Depending on the material web thickness, the completely wetted material web can have the same properties on both sides due to the permeation of the wetting chemical.

In one embodiment of this invention, the application means is provided in the form of at least one application roller which rotates in a trough containing the wetting liquid and around which the material web is guided. A striped application can be achieved with covering strips that are placed onto certain regions of the application roller. Basically, other application mechanisms such as a spray application are also possible.

Preferably, the guide means are provided in the form of guide rollers and at least one immersion roller by which it is possible to guide the material web in a straight and taut fashion around the application means, in particular around the application roller. The immersion roller in this case is generally vertically adjustable, allowing its position to be selected so that the material web contacts the application roller.

In one embodiment of this invention, the spray guard according to this invention is embodied in a form of a film with a sufficient chemical resistance. In another embodiment of this invention, the film is composed of polytetrafluoroethylene (PTFE, for example known as Teflon® from the DuPont Company). Such films are impermeable to liquids so that in the region in which the material web is covered by the film, none of the wetting chemical can emerge. The films can adapt to the material web in an extremely flexible way and are inexpensive to manufacture and provide. PTFE also has a very high chemical resistance and is not susceptible to corrosion even by aggressive chemicals. In addition, it has a very low coefficient of friction so that despite resting snugly against the moving material web, the PTFE film does not exert excessive resistance on it and only experiences a small amount of wear. Due to its very low surface tension, PTFE can only be wetted with difficulty so that as explained above, liquid that passes through the material web is immediately cleaned from the subsequent material web and does not stick permanently to the film. In addition to using a PTFE film to embody the spray guard according to this invention, it is also possible to use other materials produced on the basis of PTFE, for example PTFE-coated fabric webs, fabrics woven from strips of PTFE film, and the like.

According to one embodiment of this invention, the spray guard, which is preferably of a film, extends over a region in which the wetting takes place in the travel direction L of the material web, for example, with the use of an application roller, generally over the apex of the application roller, and over a region before and after it of, for example, at most 1 m respectively, preferably at most 0.75 m respectively, as well as at least across the entire width of the material web. This assures that in a defined region around the application means, no liquid can be hurled from the material web.

In a particularly preferred embodiment of this invention, the spray guard is held against the material web by holding means. For example, these holding means can be embodied in the form of at least two hollow profiles that extend transversely relative to the travel direction L of the material web and between which the spray guard is clamped at its two ends. The holding means are preferably vertically adjustable so that through appropriate positioning of the holding means, the film can be kept taut and pressed against the traveling material web and in order to increase the tension, can be lightly pressed into it.

In addition, the holding means press the sandwich, including the material web and film, against the application roller so that a constant pressing force is exerted on the application roller surface and a uniform wetting of the material web can take place without forming dead spaces between the application roller, the material web, and the film and without permitting the material web to start fluttering against the application roller.

In such an embodiment of this invention, it is also possible for the film serving as a spray guard to be merely placed against the material web, for example hydrophobic production, or to produce a definite pressing force against the material web through corresponding adjustment of the holding means, such as a hydrophilic production.

BRIEF DESCRIPTION OF THE DRAWING

This invention is explained in greater detail in view of an exemplary embodiment and with reference to the accompanying drawings, wherein:

The FIGURE is a schematic depiction of the apparatus according to one embodiment of this invention.

DESCRIPTION OF PREFERRED EMBODIMENTS

The apparatus for wetting a material web with a liquid, which is labeled as a whole with the reference numeral 1 in the FIGURE, includes guide rollers 6 and an immersion roller 7 that is guided so that it is vertically adjustable according to the arrows H2 and the rollers guide a material web 2 at a definite material web speed in a travel direction L around an application roller 5. The application roller 5 rotates in a trough 9 filled with a chemical 3 in which it is partially immersed. The chemical 3 is used to impregnate the material web 2 and is transferred to the material web 2 by means of or through contact in the region of or near an apex S of the application roller 5.

On the side of the material web 2 oriented away from the application roller 5, a spray guard embodied in the form of a film 4 comprising of polytetra-fluoroethylene (PTFE) rests against the material web 2. For example, the film 4 can be 0.1 mm to 1 mm thick and is not shown to scale in the FIGURE, particularly in relation to the thickness of the material web 2. The film 4 extends in the travel direction L of the material web 2 over the region of the apex S of the application roller 5 in which the wetting occurs and over a region of approximately 0.5 m respectively before and after it. The film 4 extends across an entire width of the material web 2 and transversely to the travel direction L.

At both of its ends oriented toward the guide rollers 6 and the immersion roller 7, the film 4 is clamped in holding means 8, which are embodied in the form of hollow profiles and also extend transversely to the travel direction L and hold the film 4 against the material web 2. Thus, the holding means 8 are embodied as vertically adjustable in accordance with arrows H1, H3 so that the film 4 can first be brought into contact with the material web 2, then pressed against the material web 2, and in order to increase the tension, lightly pressed into it. The vertical adjustment can act equally on both holding means 8 or each holding means 8 can be associated with its own independent vertical adjustment. In addition, the holding means 8 press the sandwich which is of the film 4 and the material web 2 against the application roller 5 with a constant pressing force. This permits a uniform wetting of the material web 2 with the chemical 3, without creating dead spaces between the application roller 5, the material web 2, and the film 4 in which liquid could collect. This operating mode is referred to as hydrophilic production.

The film 4 prevents portions of the chemical 3 that pass through the material web 2 in the vicinity of or near the application roller 5 from dislodging from the material web 2 and escaping into the surroundings. This prevents contamination of the surrounding pieces of equipment, the floor, and the ambient air and can save significant quantities of the chemical 3. At the same time, it is possible to eliminate extraction devices for extracting aerosol mist, thus simplifying the engineering or design of the equipment.

In a modification of the operating mode shown in the FIGURE, the holding means 8 and also the usually vertically adjustable immersion roller 7 can be adjusted so that the material web 2 travels over the application roller 5 in a straight line with the film 4 serving as a spray guard to maintain its surface contact with the material web 2 as before. This operating position is referred to as hydrophobic production.

In summary, this invention provides an apparatus that avoids the production of an aerosol mist when wetting a material web with a liquid and also avoids the accompanying disadvantages, thus achieving a significant cost savings in wetting liquid.

One advantage of the apparatus according to this invention is its flexibility and in its ease of retrofitting. The spray guard can thus be inexpensively adapted to different material web dimensions and built into a wide variety of system types, even after their manufacture.

European Patent Application No. 11180429.0, filed 7 Sep. 2011, the priority document corresponding to this invention, to which a foreign priority benefit is claimed under Title 35, United States Code, Section 119, and its entire teachings are incorporated, by reference, into this specification.

What is claimed is:

1. An apparatus for wetting a material web (2) with a liquid (3), the apparatus comprising:

guide means for guiding the material web (2);

application means for applying the liquid (3) to the material web (2); and a spray guard which is applicable to the material web (2) to be wetted, wherein the material web (2) is guidable in a travel direction (L) between the application means and the spray guard, wherein the spray guard is formed as a film (4) having a length in the travel direction maintained in surface contact with the material web, the film is held at each of opposing ends by holding elements, an entire length of a surface of the film extending between the holding elements contacts a second side of the material web that is opposite the application means, and a first of the holding elements is positioned on a first side of the application means in the travel direction and a second of the holding elements is positioned on an opposing second side of the application means in the travel direction.

2. The apparatus as recited in claim 1, wherein the application means are formed as at least one application roller (5).

3. The apparatus as recited in claim 2, wherein the guide means comprise guide rollers (6) and at least one immersion roller (7).

4. The apparatus as recited in claim 1, wherein the spray guard is produced as a polytetrafluoroethylene film.

5. The apparatus as recited in claim 4, wherein the spray guard surface contact with the material web extends in the travel direction (L) of the material web, over a region of wetting and over a region before and after at most 1 m respectively, and transversely to the travel direction L at least across an entire width of the material web (2).

6. The apparatus as recited in claim 1, wherein the holding elements (8) comprise at least two hollow profiles.

7. The apparatus as recited in claim 6, wherein the holding elements (8) are vertically adjustable.

8. The apparatus as recited in claim 1, wherein the guide means comprise guide rollers (6) and at least one immersion roller (7).

9. The apparatus as recited in claim 1, wherein the spray guard surface contact with the material web extends in the travel direction (L) of the material web, over a region of wetting and over a region before and after at most 1 m respectively, and transversely to the travel direction L at least across an entire width of the material web (2).

10. The apparatus as recited in claim 1, wherein the film is positioned over the application means with a first film end held in position upstream of the application means in the travel direction and an opposing second end held in position downstream of the application means in the travel direction.

11. The apparatus as recited in claim 10, wherein the first film end and the second film end are each clamped in one of the holding elements.

12. The apparatus as recited in claim 1, wherein the entire length of the surface of the film extending between the holding elements is pressed into the second side of the material web.

13. An apparatus for wetting a material web (2) with a liquid (3), the apparatus comprising:

guide rollers configured to guide the material web (2) in a travel direction (L);

an application roller positioned against a first side of the material web, wherein the application roller is adapted to apply the liquid (3) to the material web (2); and a spray guard formed as a film (4) held at each of opposing ends by holding elements, wherein an entire length of a surface of the film extending between the holding elements contacts a second side of the material web that is opposite the application roller, wherein a first of the holding elements is positioned on a first side upstream of the application roller in the travel direction and a second of the holding elements is positioned on an opposing second side downstream of the application roller in the travel direction.

14. The apparatus as recited in claim 13, wherein the film comprises polytetrafluoroethylene.

15. The apparatus as recited in claim 13, wherein the holding elements (8) comprise at least two hollow profiles.

16. The apparatus as recited in claim 13, wherein the holding elements are movable on and off of the second side of the material web.

17. The apparatus as recited in claim 13, wherein the spray guard surface contact with the material web extends in the travel direction (L) of the material web, over a region of wetting and over a region before and after at most 1 m respectively, and transversely to the travel direction L at least across an entire width of the material web (2).

18. The apparatus as recited in claim 13, wherein a first end and a second end of the film are each clamped in one of the holding elements.

19. The apparatus as recited in claim 13, wherein the entire length of the surface of the film extending between the holding elements is pressed into the second side of the material web.

20. The apparatus as recited in claim 1, wherein the spray guard surface contact with the material web extends in the travel direction (L) of the material web, over a region of wetting and over a region before and after at most 0.75 m respectively, and transversely to the travel direction L at least across an entire width of the material web (2).

* * * * *